US008888469B2

(12) United States Patent
Lefebvre

(10) Patent No.: US 8,888,469 B2
(45) Date of Patent: Nov. 18, 2014

(54) PUMP WITH AN ELASTIC MEMBRANE AND HYDRAULIC CONTROL

(75) Inventor: Rémy Lefebvre, Radepont (FR)

(73) Assignee: Milton Roy Europe, Point Saint Pierre (FR)

( * ) Notice: Subject to any disclaimer, the term of this patent is extended or adjusted under 35 U.S.C. 154(b) by 343 days.

(21) Appl. No.: 13/145,254

(22) PCT Filed: Feb. 3, 2010

(86) PCT No.: PCT/FR2010/000081
§ 371 (c)(1),
(2), (4) Date: Jul. 19, 2011

(87) PCT Pub. No.: WO2010/089476
PCT Pub. Date: Aug. 12, 2010

(65) Prior Publication Data
US 2011/0280747 A1 Nov. 17, 2011

(30) Foreign Application Priority Data
Feb. 3, 2009 (FR) ..... 09 00440

(51) Int. Cl.
*F04B 9/08* (2006.01)
*F04B 43/067* (2006.01)
*F04B 43/00* (2006.01)
*F04B 43/073* (2006.01)

(52) U.S. Cl.
CPC ..... *F04B 43/067* (2013.01); *F04B 43/0081* (2013.01); *F04B 43/073* (2013.01); *F04B 43/009* (2013.01)
USPC ..... 417/385; 417/395

(58) Field of Classification Search
CPC ..... F04B 43/067
USPC ..... 417/379, 385–388, 395, 383
See application file for complete search history.

(56) References Cited

U.S. PATENT DOCUMENTS

| | | | | | |
|---|---|---|---|---|---|
| 2,427,818 | A * | 9/1947 | Taylor | 417/199.1 |
| 2,578,746 | A * | 12/1951 | Scherger et al. | 417/388 |
| 3,612,727 | A * | 10/1971 | Drake | 417/388 |
| 3,828,812 | A * | 8/1974 | Read | 137/557 |
| 4,416,599 | A * | 11/1983 | De Longchamp | 417/386 |
| 4,832,581 | A * | 5/1989 | Muller et al. | 417/383 |
| 6,264,436 | B1 * | 7/2001 | Edwards et al. | 417/388 |
| 7,425,120 | B2 * | 9/2008 | Hembree | 417/387 |

FOREIGN PATENT DOCUMENTS

| | | |
|---|---|---|
| FR | 2 461 131 A | 1/1981 |
| FR | 2 566 054 A | 12/1985 |
| GB | 1 300 500 A | 12/1972 |

* cited by examiner

*Primary Examiner* — Peter J Bertheaud
*Assistant Examiner* — Dnyanesh Kasture
(74) *Attorney, Agent, or Firm* — Muncy, Geissler, Olds & Lowe, P.C.

(57) ABSTRACT

A hydraulically-controlled diaphragm pump including a pump chamber formed between a pump head and a pump body, a constant volume intermediate hydraulic chamber formed in the pump body and including a piston driven with reciprocating motion inside the intermediate chamber, a leak compensation volume for compensating leaks from the intermediate chamber being connected thereto by a top-up channel via a free check valve that is not rated and that passes fluid towards the working chamber. The check valve and at least a portion of the compensation volume are housed in a body fitted to the pump body at the high point of the intermediate hydraulic chamber in the working position of the pump.

10 Claims, 2 Drawing Sheets

PUMP WITH AN ELASTIC MEMBRANE AND HYDRAULIC CONTROL

The present invention relates to hydraulically-controlled diaphragm pumps, and more particularly to the device for maintaining an appropriate volume of liquid in the intermediate chamber that exists between the piston and the diaphragm.

BACKGROUND OF THE INVENTION

The liquid present in the intermediate chamber presents a volume that decreases for three main reasons: the existence of leaks, the existence of dissolved gas that affects the performance of the pump, and the presence of a safety valve that enables fluid to be discharged in the event of excess pressure.

With this type of pump, it is therefore necessary to provide a system for topping up the chamber in question, generally from an auxiliary tank. Said system, referred to as a compensation system, should maintain a volume of liquid in the intermediate chamber that makes it possible under all working conditions for the diaphragm to travel through a distance corresponding to the cylinder capacity swept by the piston, and without running the risk of damaging the diaphragm or disturbing the flow.

Known top-up devices are of two main types: automatic devices and controlled devices. Automatic devices are constituted by a simple rated suction valve that opens from the tank to the intermediate chamber as from a certain level of reduced pressure. Controlled devices comprise one or more valves that are opened mechanically by the movement of the diaphragm and that enable topping up to take place only when the diaphragm is in its extreme rear position.

In both cases, the diaphragm is deformable without significant stiffness or elasticity, such that the suction level of the pump is a function of the pressure in the intermediate chamber. Under such conditions, automatic systems suffer from the drawback of greatly decreasing the suction capacity of the pump compared with that of a piston pump, since the valve needs to be rated so that it opens as late as possible before cavitation occurs in the intermediate chamber, and suction ceases immediately at the moment that this opening occurs. If the diaphragm has not traveled over its full suction stroke, then the cylinder capacity of the pump is affected.

Certain known controlled systems include a valve that co-operates with a stationary seat through which the top-up duct opens out into the intermediate chamber, the valve being urged against its seat by a spring and being opened by the diaphragm when it tends to go past the end of the pump suction stroke. In most circumstances, the diaphragm is flexible with practically no stiffness.

In certain low-flowrate pumps, the diaphragm used is in is the form of a dome or a cone that is elastically deformable, presenting great stiffness and possessing a memory of its rest shape that corresponds to the end of the suction stroke and to which it returns elastically when pressure ceases to exist in the intermediate chamber.

The small cylinder capacity of such pumps prevents known devices for performing the top-up function from being transposed simply. It is therefore appropriate to adapt the compensation system to the particular conditions in which such pumps operate. The invention consists in making this adaptation and it leads to miniaturization of the circuit for compensating the working chamber, the invention also presenting advantages, in particular a reduction in size, in pumps that present higher flow rates.

OBJECT OF THE INVENTION

Thus, the invention provides a hydraulically-controlled diaphragm pump comprising a pump chamber formed between a pump head and a pump body with a movable wall formed by a diaphragm that is elastically deformable from its rest shape that corresponds to its state at the end of the suction stroke of the pump, a constant volume intermediate hydraulic chamber formed in the pump body adjacent to the pump chamber level with the diaphragm and including a piston driven with reciprocating motion inside said intermediate chamber, a leak compensation volume for compensating leaks from the intermediate chamber being connected thereto by a top-up channel via a free check valve that is not rated and that passes fluid towards the working chamber, wherein the check valve and at least a portion of the compensation volume are housed in a body fitted to the pump body at the high point of the intermediate hydraulic chamber in the working position of the pump.

For assembly reasons, the fitted body is in two portions, namely a lower partitioning element carrying the seat of the free check valve, and a holder element for holding the partitioning element and forming a tank for the compensation volume and for closure thereof.

The volume of the intermediate chamber (or working chamber) is shared between a main volume that is swept by the end of the piston in its reciprocating motion and a smaller secondary volume formed by the extremely short top-up duct and functional spaces that exist because the pump body is made up of a plurality of parts that are assembled together to define the working chamber. This volume is thus reduced to the minimum needed for operation of the pump, with dead volumes that are small and practically without any sealing gaskets that are subjected to the high pressure and that are thus likely to modify the volume of the working chamber by being deformed. The channels forming part of the secondary volume of the working chamber may be of small sections, since the fluid used is of very high quality without any solid particles and with little dissolved gas.

Thus, the invention makes it possible to reduce the capacity of the compensation volume of fluid needed for topping up the intermediate hydraulic chamber to a few cubic centimeters. The compensation volume is also shared between the fitted body that contains the major fraction of this volume by forming a tank that is installed radially in the pump body, e.g. in the portion of said body that is adjacent to the bearing surface for guiding the working piston and the various functional clearances and channels that are at atmospheric pressure, in the vicinity of the bearing surface for guiding the working piston and in communication with the tank.

In the meaning of the invention, the free check valve may be completely free of any spring urging it against its seat, as may happen when the return force is provided by the force of gravity, or else it may be a valve in which closure is assisted by a spring that has the function of compensating the effect of gravity, e.g. if the effect of gravity is to move the valve member away from its seat.

Furthermore, the working chamber is also connected to the compensation volume tank via a discharge channel and through a rated safety valve that closes the channel when the pressure in the working chamber is below the rated value. The above-mentioned fitted body includes this discharge channel in parallel with the free valve in the partitioning element.

Furthermore, a venting channel is provided in parallel with the rated safety valve between the intermediate hydraulic chamber and the tank for the compensation volume.

It should be observed that the top wall of the fitted body is transparent.

Advantageously, the safety valve advantageously includes a rod having its free end constituting an indicator of the existence of excess pressure in the working chamber.

Finally, a space forming part of the compensation volume is provided between the piston and its guide sleeve and forms means for collecting leaks between the piston and the sleeve.

Other characteristics and advantages of the invention appear from the description given below of an embodiment of the invention.

BRIEF DESCRIPTION OF THE DRAWINGS

Reference is made to the accompanying drawings, in which.

DETAILED DESCRIPTION OF THE INVENTION

Figure 1:
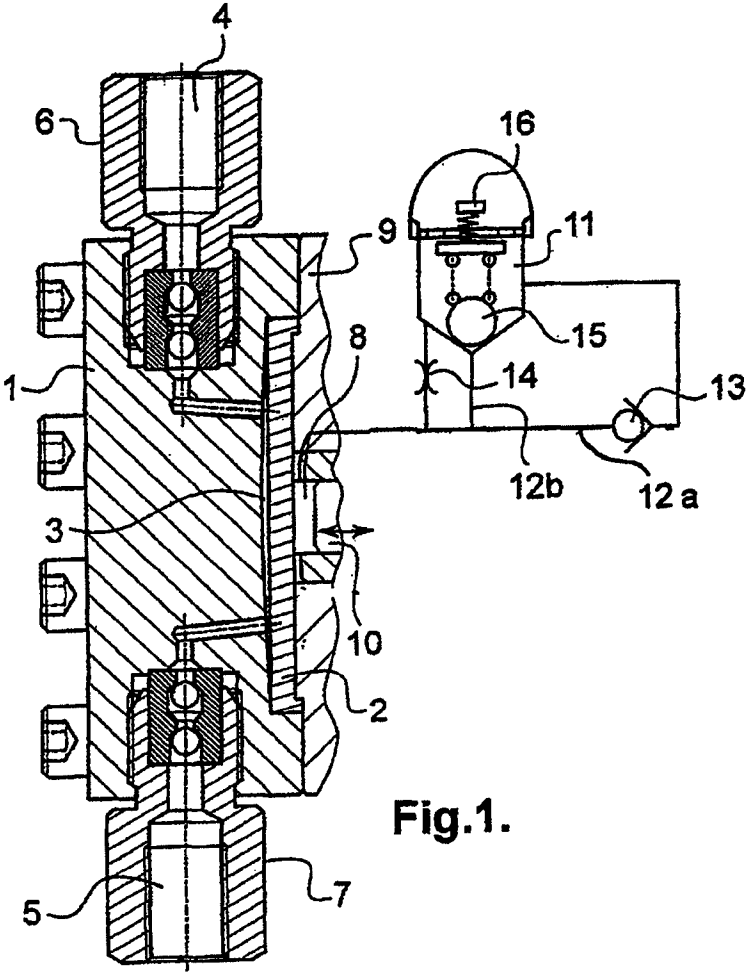
FIG. 1 is a functional diagram of a pump of the invention.

With reference to FIG. 1, there can be seen a hydraulically-controlled pump head comprising a pump head 1 that co-operates with a diaphragm 2 to define a pump chamber 3. The diaphragm 2 is elastically deformable from its rest shape (the shape shown) that corresponds to its shape at the end of a suction stroke of the pump. The stiffness of the diaphragm is such that the suction power of the pump is defined by the capacity of the diaphragm to return on its own into its rest position. More specifically, the pump is a low flow rate and medium or high pressure pump.

The pump chamber is connected to the outside via a suction channel 4 and a delivery channel 5 that are fitted with respective check valves contained in valve boxes 6 and 7.

The diaphragm constitutes the deformable wall of an intermediate hydraulic chamber 8 formed in the body 9 of the pump. A piston 10 is driven mechanically with reciprocating motion in the intermediate chamber 8 by a motor and a transmission that are themselves known. The volume of the chamber 8 is theoretically constant and the volume swept in said chamber by the piston 10 corresponds to the variation in volume of the pump chamber 3. Although the fluid contained in the chamber is indeed incompressible, its volume varies as a result of leakage between the piston and the guide for guiding its reciprocating motion inside the pump body. Furthermore, the working fluid contains dissolved gas that is released during the compression-decompression cycles to which it is subjected. Finally, a safety valve allows the fluid to be exhausted from the intermediate chamber in the event of a blockage occurring in the pump chamber. The volume of the chamber 8 is therefore not constant and it is appropriate to make provision for compensating the lost fluid by sucking in a sufficient quantity of fluid during the suction stroke of the piston 10.

For this purpose, the intermediate chamber 8 is in communication with a compensation tank 11 via two channels 12*a* and 12*b*. The channel 12*a* is a top-up channel that connects the working chamber to the compensation tank 11. The channel 12*a* includes a check valve 13 that is free, i.e. the valve member drops freely onto its seat or is urged thereagainst by an assistance spring that is very weak. The flow direction goes from the tank 11 towards the intermediate chamber 8.

The channel 12*b* is a discharge channel and includes a rated valve 15 that constitutes the above-mentioned safety valve for the chamber 8. This valve passes fluid from the chamber 8 to the tank 11 if the pressure in the chamber 8 exceeds a threshold value that is adjustable by adjusting the rating of the valve by means of a screw 16, for example. A vent passage for venting the gas contained in the chamber 8 may be provided in parallel with the safety valve 15, e.g. as represented by the channel 14.

It can be understood that a rearward stroke of the piston 10 allows the diaphragm 3 to return elastically into its rest position. If it reaches this position before the piston reaches its rear dead-center point, then suction occurs in the chamber 8 that gives rise to a volume of liquid being sucked in from the tank 11 via the valve 13. Furthermore, while the pump is in operation, the gas contained in the working liquid of the chamber 8 is vented continuously during compression and suction cycles via the channel 14. By precaution, the channel 12*a* is located above the chamber 8 so as to take advantage of the natural accumulation of gas at the high point of said chamber. Finally, if a blockage occurs in the pump chamber, the fluid in the chamber 8 may be discharged via the channel 12*b* through the safety valve 15 that opens out into the tank 11.

The portion of the channel 12*a* that lies downstream from the check valve 13 relative to its flow-passing direction, contributes in prior art pumps to satisfying the need to compensate for losses of the cylinder capacity of the pump. This channel portion is generally made in the form of independent pipes that are connected together by joints that give rise to leaks of the fluid contained in the pipes, given that said fluid is subjected to pressure variations while the pump is in operation and presents a volume that is large compared with the volume of the working chamber of a small-flowrate pump.

The invention relates to a construction measure having as one of its advantages minimizing this "dead" volume of fluid that is confined under sealing that is strengthened in order to reduce the compensation needs of the working chamber of the pump.

Figure 2A:
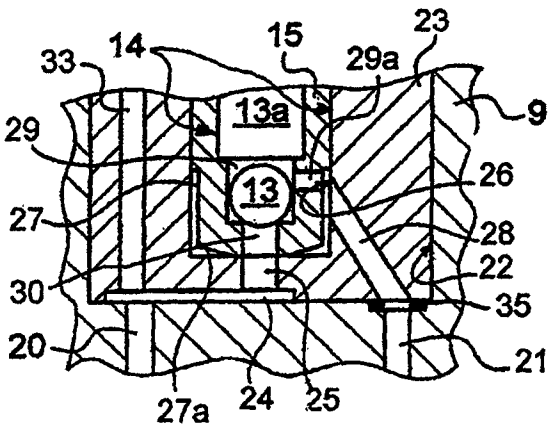
FIG. 2A is a fragmentary enlargement of FIG. 2.
Figure 2:
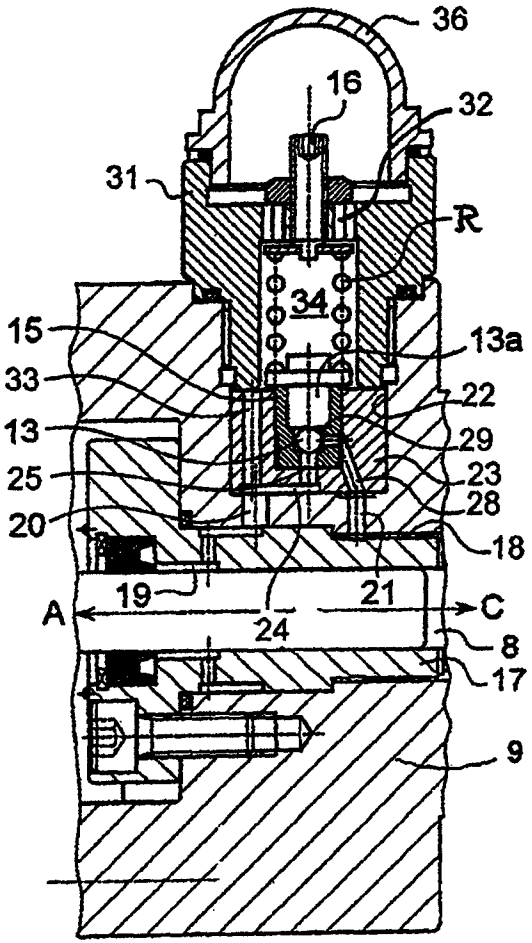
FIG. 2 is a section view of a first embodiment of the FIG. 1 pump.

FIGS. 2 and 2A show certain elements as described above and given the same references. The piston 10 is slidably mounted in a guide sleeve 17 fitted in the pump body 9 in such a manner that this guide 17 co-operates with the body 9 of the pump that receives it to define beside the intermediate chamber 8 an annular space 18 that is open to the intermediate chamber 8 and that forms a portion of the channel 12*a* or a portion of the chamber 8.

In this embodiment, the sleeve 17 also co-operates with the piston 10 to define a collection chamber 19 for collecting leaks of working liquid.

The chamber 8, the annular space 18, and the chamber 19 are connected by channels 20 and 21 to a cavity 22 formed in the body 9 of the pump, in which cavity a tubular partitioning element 23 is housed. This partitioning element in the cavity 22 defines a chamber 24 into which the channel 20 coming from the leak collection chamber 19 opens out.

The bottom of the tubular partitioning element 23 possesses a central channel 25 that communicates with the chamber 24. This channel opens out into a housing 26 of the partitioning element in which the safety valve 15 is housed. The seat of this valve 15 is constituted by the bottom of the housing 26 around the outlet of the channel 25. Above this seat, the valve 15 defines an annular chamber 27 in the housing 26 into which an extension 28 of the channel 21 formed in the partitioning element 23 opens out.

The chamber 29 formed in the valve 15 communicates with the channel 25, and thus with the chamber 24, via a channel 30 that includes the check valve 13, which valve passes fluid from the chamber 24 towards the chamber 29.

It can be seen that the check valve 13 in this embodiment is a valve having a ball that moves relative to a seat carried by the rated valve 15 at the outlet from the channel 30 into the chamber 29. The stroke of this check valve is limited by an abutment 13*a* housed in the safety valve 15. The chamber 29 is above the ball and below the abutment 13*a*.

The annular chamber 27 is in permanent communication with the chamber 29 via a channel 29*a* passing through the body of the safety valve 15. The end of the valve 15 facing the bottom of the housing 26 is conical, thereby enabling the pressure that exists in the chamber 29 and thus in the chamber 8 to exist in the chamber 27*a* and to be applied against a large working area of the safety valve 15. Above the annular chamber 27, the safety valve 15 slides in the housing 26.

Inside the partitioning element 23, the safety valve 15 is urged against its seat by a spring R.

A tubular element 31 forms the enclosure of the compensation tank 34 and is in screw co-operation with a tapped portion 22*a* of the cavity 22 so as to hold the partitioning element 23 firmly at the bottom of said cavity. This tubular element carries a perforated transverse partition 32 for supporting the screw 16 for adjusting the rating of the return spring of the safety valve 15.

The spring R thus extends between the screw 16 and the valve 15 in the inside space of the element 31 that constitutes a tank 34 that is the main portion of the compensation volume 11.

A channel 33 formed in the partitioning element 23 permanently connects the tank 34 to the chamber 24. A gasket 35 is provided at the connection between the channels 21 and 28.

A removable transparent cover 36 is fitted on top of the assembly and closes the compensation volume, while giving access thereto in order to enable oil to be added, should that be necessary, and also enabling various checks to be performed on the operation of the pump. The level of the working oil, i.e. of the fluid contained in the intermediate hydraulic chamber and in the compensation volume is adjusted so as to be functionally above the perforated partition 32.

It should be observed that the portion of the top-up channel 12*a* that is downstream from the check valve 13 (with reference to FIG. 1) here comprises the chamber 29, the hole 29*a*, the channel 28, and the channel 21, and that the upstream portion of the discharge channel 12*b* also includes the chamber 27 and the chamber 27*a* in addition to the above-mentioned channels and spaces. The compensation volume is made up of all of the portions of the hydraulic circuit that are at atmospheric pressure, namely the chambers, channels, volumes, and orifices 19, 20, 24, 25, 30, 33, and 34.

The vent channel 14 in this embodiment is constituted by the cylindrical functional clearance that exists between the abutment 13*a* of the check valve 13 and the inside surface of the safety valve 15, and also by the functional clearance that exists between the safety valve 15 and the housing 26 of the element 23.

In operation, when the piston 10 moves in the suction direction A, the elastic return of the diaphragm towards its rest state is possible. Generally, the pressure in the chamber 8 is greater than atmospheric pressure. Nevertheless, the volume of liquid in the chamber 8 may be less than the volume in the working chamber (naturally plus the volume of all of the auxiliary channels and chambers that communicate freely with the chamber 8 as a result of the permanent leaks of said fluid and for venting). Under such circumstances, the last portion of the piston suction stroke may give rise to a pressure reduction in said chamber and the check valve 13 opens. Additional liquid is thus admitted into the intermediate hydraulic chamber 8 and the cylinder capacity of the pump is preserved. A compensation flow rate is thus fed to the hydraulic chamber when required.

During the delivery stroke (direction C in the figures), the pressure in the chamber 8 is very high, thereby closing the check valve 13. It is during this portion of the stroke that the leaks occur. If the pressure is higher than a critical value corresponding to the rating of the safety valve 15, the valve member of this safety valve 15 opens and the excess pressure is discharged into the space 34 above the partitioning element 23 via the ducts 25, 24, and 33. The turbulence that follows in the oil at the surface of the tank 34 is seen by the operator as indicative of this malfunction. In this embodiment, and where necessary, the working fluid is vented on each stroke of the pump along the capillary channel 14 that exists between the abutment 13*a* of the check valve 13 and the valve member of the safety valve 15.

Figure 3:
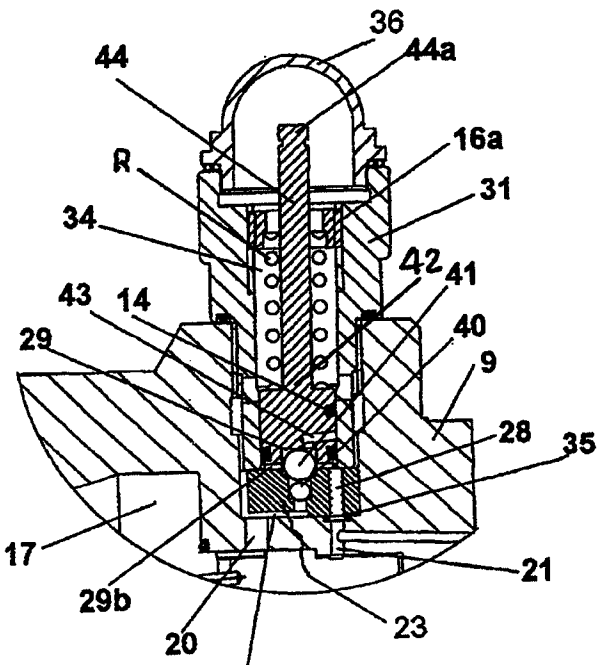
FIG. 3 is a fragmentary enlargement of a preferred variant embodiment of the invention.

FIG. 3 shows a preferred variant embodiment of the invention. The embodiment differences relate to the body fitted to the pump body 9. The partitioning element 23 carries two ball check valves 40 and 41 in series. The valves are no longer provided inside the body of the safety valve 15. The channel 21 extended by the channel 28 is in communication with a section 29*b* of the chamber 29 around the second check valve 41. The chamber 29 is situated above the element 23 and is hollowed out like a spot face of the valve member of the safety valve 15 of a slider 42 with an internal channel 43 that extends from the high point of the chamber 29.

Under the effect of excess pressure, the slider is lifted against the effect of the return spring R, the excess pressure being the pressure that may occur in the working chamber 8, 18 and that reaches the chamber 29 via the channels 21 and 28. The slider 42 is no longer properly speaking a safety valve through which fluid under excess pressure passes. Together with the element 31 in which it is slidably guided, it constitutes a variable-volume capacity that constitutes an expansion chamber in order to limit the pressure in the channels to the pressure set by the rating of the spring R. The spring R tends to press the slider 42 against the partitioning element 23 thus minimizing the volume of the chamber 29. Between the slider 42 and the element 31, functional clearance serves as a vent channel 14 at the outlet from the channel 43.

In order to compare this embodiment with the embodiment of FIG. 1, the pressurized portion of the channel 12*a* comprises the channels 21, 28, the chamber 29 with its section 29*b* (plus the volume of the blind channel 43), while the pressurized portion of the channel 12*b* comprises the channels and spaces 28, 29*b*, 29, and 43, the spaces 29 and 29*b* being variable-volume spaces.

Finally, it should be mentioned that the slider 42 is provided with a rod 44 having an end 44*a* that may be colored and that constitutes an indicator of excess pressure in the working chamber and thus of abnormal operation of the pump. Through the transparent window 36, an operator can easily see any beating of the end 44*a* of the rod 44 under this wall, indicating for example that the delivery circuit of the pump is closed. It is then possible for the operator to intervene quickly. In order to ensure that this indicator is visible, the screw 16 for rating the safety valve is replaced in this variant by a hollow screw 16*a*.

It is found that the volume of fluid that is subjected to high pressure and to cyclical variations is limited by walls that are not deformable, i.e. that do not include any gaskets other than the O-ring gasket 35 at the junction between the channels 21 and 28. This arrangement contributes to ensuring that the cylinder capacity of the pump remains stable over time.

This variant embodiment operates as follows. In the event of fluid missing from the working volume of the pump, at the end of the suction stroke, the pressure in the chamber 29 is less than atmospheric pressure. The check valves 40 and 41 open and the working volume is topped-up. During the delivery stroke, the check valves 40 and 41 are pressed against their seats by the delivery pressure and the working fluid is held captive in the working chamber, ignoring leaks, which are small and compensated during the following suction stroke.

One of the advantages of these embodiments lies in the compactness of the assembly, the compensation chamber being shared amongst various housings formed in the body of the pump and mainly in the fitted body that contains the compensation valve and the safety valve. Space occupied in the working direction of the piston is thus reduced since the compensation volume, which used conventionally to be housed in the casing of the pump between the motor acting on the piston and the working chamber, now has the major fraction of its volume situated outside the casing.

Furthermore, the cylindrical partitioning element 23 houses the two valves and is itself housed in the recess 22 in the pump body that extends perpendicularly to the axis of the piston 10. The compensation, safety, and venting functions plus a display function are provided by an assembly that is mounted like a cartridge in the transverse recess 22 of the pump body 9, i.e. the cylindrical partitioning element 23, the two check valves 40 and 41, the spring R, and the tubular element 31 for fastening said partitioning element in the cavity 22 of the pump body that closes the main tank 34 of the compensation volume, which cartridge carries the means for rating the safety valve or the slider that slides in the expansion chamber and makes it possible by means of a transparent cover 36 to monitor the operation of the device and in particular to diagnose the delivery pressure of the pump by visual inspection.

What is claimed is:

1. A hydraulically-controlled diaphragm pump comprising;

a pump chamber formed between a pump head and a pump body with a movable wall formed by a diaphragm that is elastically deformable from its rest shape that corresponds to its state at the end of a suction stroke of the pump, an intermediate hydraulic chamber formed in said pump body adjacent to a pump chamber level with the diaphragm and including a piston driven with reciprocating motion inside said intermediate hydraulic chamber, the volume of the intermediate hydraulic chamber being theoretically constant but varying in service as a result of leaks between the piston and a guide for guiding the piston's reciprocating motion, a leak compensation volume for compensating said leaks from the intermediate hydraulic chamber being connected thereto by a top-up channel via a free check valve that is not rated and that passes fluid towards the intermediate hydraulic chamber, wherein the check valve and at least a portion of the compensation volume are housed in a separate body fitted to the pump body at a highest point of the intermediate hydraulic chamber in a working position of the pump.

2. The pump according to claim 1, wherein the body fitted to the pump body is in two portions, namely a lower partitioning element carrying a seat of the free check valve, and a holder element for holding the partitioning element and forming a tank for the compensation volume and closure thereof.

3. The pump according to claim 2, wherein the body yfitted to the pump body defines a discharge channel connecting the intermediate hydraulic chamber to the compensation volume tank in parallel with the top-up channel and through a rated safety valve, the discharge channel being closed by the rated safety valve when a pressure is below a rating value of the rated safety valve.

4. The pump according to claim 3, wherein a venting channel is provided in parallel with the rated safety valve between the intermediate hydraulic chamber and the compensation volume tank.

5. The pump according to claim 3, wherein the seat of the free check valve is carried by the body of the safety valve.

6. The pump according to claim 3, wherein the valves lie on a common axis that is directed perpendicularly to an axis of the working piston.

7. The pump according to claim 3, wherein the safety valve advantageously includes a rod having a free end constituting an indicator of the existence of excess pressure in the intermediate hydraulic chamber.

8. The pump according to claim 2, wherein the body fitted to the pump body defines a discharge channel connecting the intermediate hydraulic chamber to an expansion chamber in parallel with the free check valve and defined by a slider sliding in the holder element and subjected to the effect of a spring tending to minimize a volume of said expansion chamber.

9. The pump according to claim 2, wherein the compensation volume tank is closed by a transparent outside wall enabling its content to be inspected visually.

10. The pump according to claim 1, wherein a portion of the compensation volume is implemented between the piston and a guide sleeve of the piston so as to constitute a leak-collecting chamber between the piston and the guide sleeve.

* * * * *